US009279554B1

(12) United States Patent
Wierzbinski

(10) Patent No.: US 9,279,554 B1
(45) Date of Patent: Mar. 8, 2016

(54) SOLAR LAMP STAND ASSEMBLY

(76) Inventor: Jerry Z. Wierzbinski, Oshawa (CA)

( * ) Notice: Subject to any disclaimer, the term of this patent is extended or adjusted under 35 U.S.C. 154(b) by 1035 days.

(21) Appl. No.: 13/416,145

(22) Filed: Mar. 9, 2012

(51) Int. Cl.
*F21L 4/00* (2006.01)
*F21S 9/03* (2006.01)

(52) U.S. Cl.
CPC . *F21S 9/037* (2013.01); *F21L 4/00* (2013.01); *F21S 9/035* (2013.01)

(58) Field of Classification Search
CPC ..... F21L 4/02; F21L 4/04; F21L 8/08; F21L 4/00; F21L 4/08; F21V 21/116; F21V 21/02; F16M 13/02; F21S 8/036; F21S 9/035; F21S 9/037
See application file for complete search history.

(56) References Cited

U.S. PATENT DOCUMENTS

| | | | | |
|---|---|---|---|---|
| 32,251 | A | 1/1861 | Marshall | |
| 1,743,694 | A | 3/1928 | Tierney | |
| 2,653,002 | A * | 9/1953 | Passman | 248/291.1 |
| D243,874 | S | 3/1977 | Smith | |
| 4,464,707 | A * | 8/1984 | Forrest | 362/222 |
| 4,631,649 | A * | 12/1986 | McCue et al. | 362/183 |
| 4,823,241 | A * | 4/1989 | Trattner | 362/183 |
| D311,722 | S * | 10/1990 | Cheng | D13/102 |
| 5,275,366 | A * | 1/1994 | Simmons | 248/205.1 |
| 5,564,822 | A | 10/1996 | Golden | |
| 5,588,630 | A | 12/1996 | Chen-Chao | |
| 5,775,032 | A * | 7/1998 | Lacy | 52/28 |
| 6,402,337 | B1 * | 6/2002 | LeVasseur et al. | 362/153.1 |
| 6,942,361 | B1 * | 9/2005 | Kishimura | F21S 8/086 362/240 |
| 8,668,347 | B2 * | 3/2014 | Ebeling | 362/95 |
| 2011/0032695 | A1 * | 2/2011 | Cumberland et al. | 362/183 |
| 2011/0108693 | A1 | 5/2011 | Thomas et al. | |

* cited by examiner

*Primary Examiner* — Stephen F Husar

(57) ABSTRACT

A solar lamp stand assembly is provided for retrofitting a solar lamp to facilitate alternative placements of the solar lamp. The assembly includes a solar lamp having a housing. An annular wall extends downwardly from the housing defining a socket. A plate and a connection member are provided. The connection member has a first end coupled to and extending from the plate. The connection member also has a free second end insertable into the socket whereby the solar lamp is coupled to and supported by the connection member and the plate.

19 Claims, 3 Drawing Sheets

SOLAR LAMP STAND ASSEMBLY

BACKGROUND OF THE DISCLOSURE

Field of the Disclosure

The disclosure relates to lamp stand devices and more particularly pertains to a new lamp stand device for retrofitting a solar lamp to facilitate alternative placement of the solar lamp.

SUMMARY OF THE DISCLOSURE

An embodiment of the disclosure meets the needs presented above by generally comprising a solar lamp having a housing. An annular wall extends downwardly from the housing defining a socket. A plate and a connection member are provided. The connection member has a first end coupled to and extending from the plate. The connection member also has a free second end insertable into the socket whereby the solar lamp is coupled to and supported by the connection member and the plate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
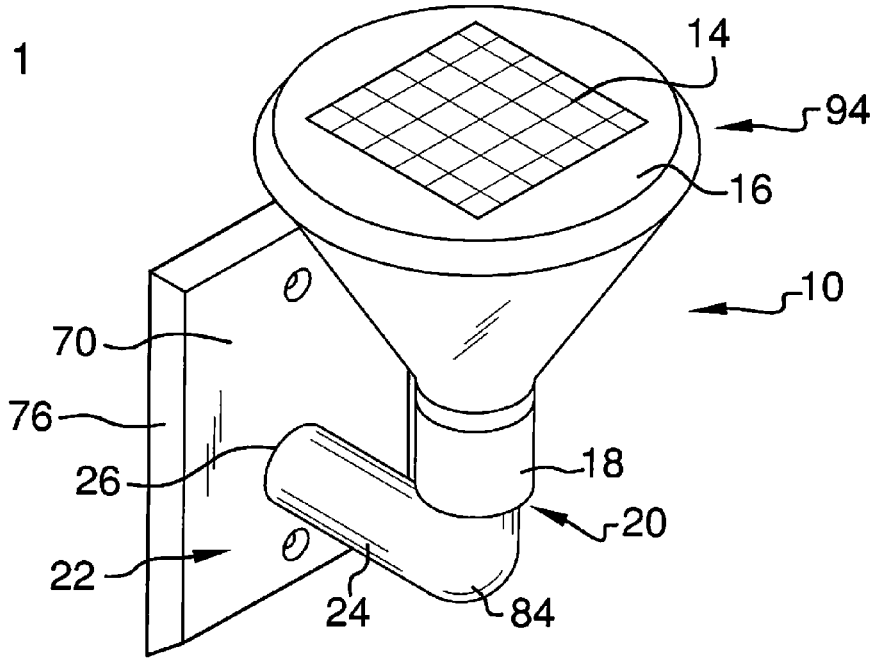
FIG. 1 is a top front side perspective view of a solar lamp stand assembly according to an embodiment of the disclosure.

With reference now to the drawings, and in particular to FIGS. 1 through 6 thereof, a new lamp stand device embodying the principles and concepts of an embodiment of the disclosure and generally designated by the reference numeral 10 will be described.

As best illustrated in FIGS. 1 through 6, the solar lamp stand assembly 10 generally comprises a solar lamp 94 having a housing 12. A panel of solar cells 14 is positioned on a top surface 16 of the housing 12. An annular wall 18 extends downwardly from the housing 12 defining a socket 20. A plate

22 is provided for support of the lamp 94 in various forms described more fully below which may be provided individually or in combination as interchangeable alternatives. In each form, a connection member 24 has a first end 26 coupled to and extending from the plate 22. The connection member 24 also has a free second end 28 insertable into the socket 20 whereby the solar lamp 94 is coupled to and supported by the connection member 24 and the plate 22.

Figure 5:
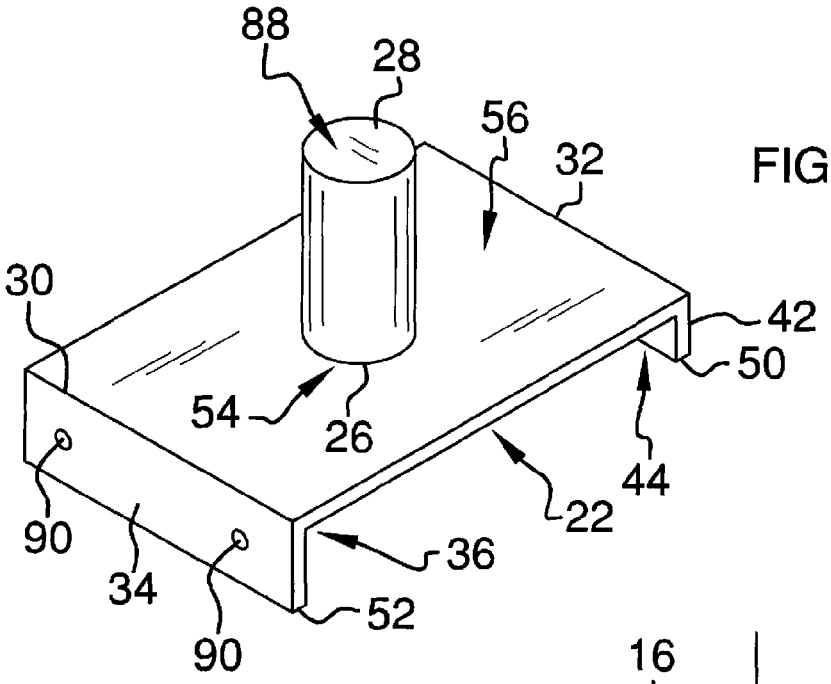
FIG. 5 is a top front side perspective view of an embodiment of the disclosure.
Figure 6:
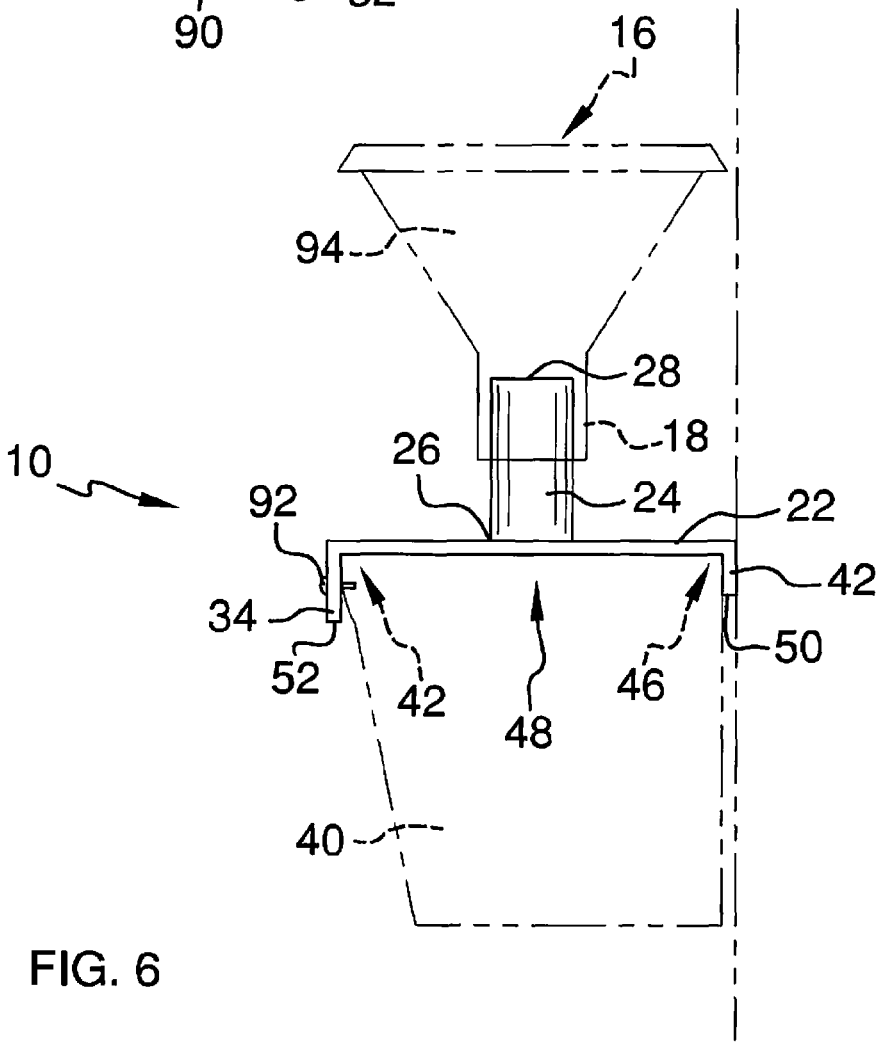
FIG. 6 is a side view of an embodiment of the disclosure in use.

In an embodiment shown in FIGS. 5 and 6, the plate 22 has a first straight edge 30 and a second straight edge 32. A first wall 34 is coupled to and extends from the first straight edge 30 defining a first lip 36 configured for engaging a first edge 38 of a trough 40. The trough 40 may be a planter such as a window box or of the type commonly hung along deck railings. The assembly 10 may also be employed with the trough 40 that is an eave trough or gutter to position the solar lamp 94 in a position heretofore not typically used for exterior illumination. A second wall 42 is coupled to and extends from the second straight edge 32 defining a second lip 44 configured for engaging a second edge 46 of the trough 40. Thus, the plate 22 is coupled to the trough 40 and the plate 22 spans an opening 48 of the trough 40. The first wall 34 and the second wall 42 may be positioned in parallel planes perpendicular to the plate 22. A height of the first wall 34 may be greater than a height of the second wall 42 whereby a bottom edge 50 of the second wall 42 is upwardly offset from a bottom edge 52 of the first wall 34 relative to the plate 22. Holes 90 may be positioned in the first wall 34 to permit secure fastening using screws 92. The connection member 24 extends perpendicularly from a center 54 of a top surface 56 of the plate 22. The connection member 24 may also have a consistent circular transverse cross-sectional shape 88 extending along a full length of the connection member 24.

Figure 4:
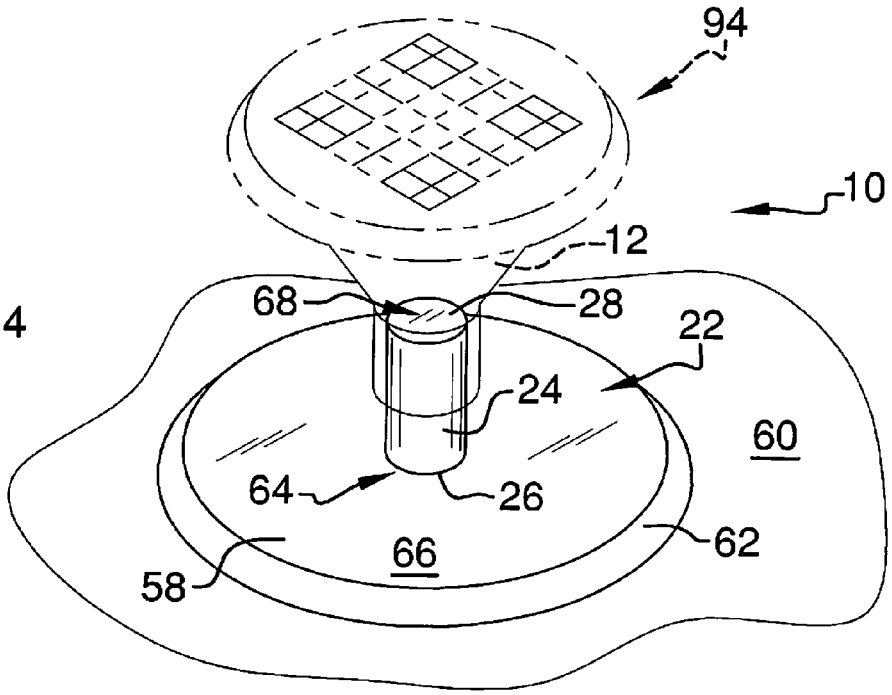
FIG. 4 is a top front side perspective view of an embodiment of the disclosure.

In another embodiment shown in FIG. 4, the plate 22 is a base plate 58 configured for standing on a support surface 60. The base plate 58 may have a beveled edge 62. The connection member 24 again extends perpendicularly from a center 64 of a top surface 66 of the base plate 58. The connection member 24 has a consistent circular transverse cross-sectional shape 88 extending along a full length of the connection member 24.

Figure 2:
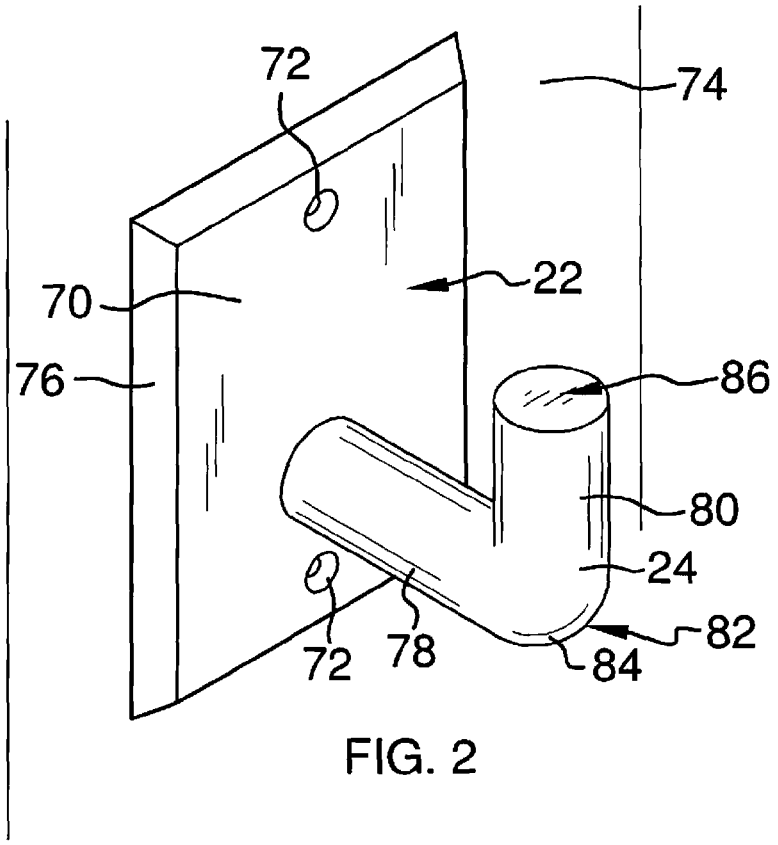
FIG. 2 is a top front side perspective view of an embodiment of the disclosure.
Figure 3:
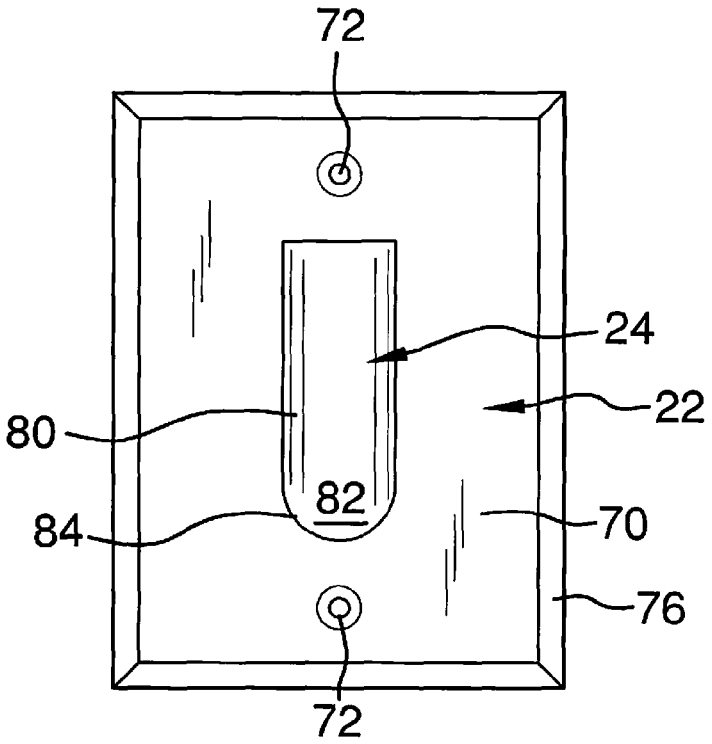
FIG. 3 is a front view of an embodiment of the disclosure.

In another embodiment shown in FIGS. 1 through 3, the plate 22 may be a faceplate 70 having a pair of spaced apertures 72 such that the faceplate 70 is configured for coupling to a vertical support wall 74. The faceplate 70 may also have a beveled edge 76 extending around the faceplate 70. The connection member 24 has a first straight section 78 extending from the faceplate 70 and a second straight section 80 extending between the first straight section 78 and the free second end 28 of the connection member 24. The second straight section 80 of the connection member 24 extends from the first straight section 78 of the connection member 24 at a right angle. An outer surface 82 of a junction 84 between the first straight section 78 and the second straight section 80 may be rounded. The second straight section 80 of the connection member 24 may have a circular transverse cross-sectional shape 86.

In use, the plate 22 and connection member 24 are used to retrofit the solar lamp 12 conventionally supported by a stake or post to a fixed vertical wall, a table top, or spanning a shallow trough such as a gutter or window box planter. All of these types of installation being impossible or impractical using the conventional stake or post.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A solar lamp stand assembly comprising:

a solar lamp having a housing, said solar lamp having a panel of solar cells positioned on a top surface of said lamp;

a continuous annular wall extending downwardly from said housing defining a socket having a single opening in spaced parallel relationship to said top surface of said lamp and facing away from said panel of solar cells;

a plate; and a connection member having a first end coupled to and extending from said plate, said connection member having a free second end, said free second end of said connection member being removably insertable into said socket such that said solar lamp rests on said connection member whereby said solar lamp is coupled to and supported by said connection member and said plate.

2. The assembly of claim 1, further including said plate being a faceplate having a pair of spaced apertures whereby said faceplate is configured for coupling to a support wall.

3. The assembly of claim 2, further including said connection member having a first straight section extending from said faceplate and a second straight section extending between said first straight section and said free second end of said connection member.

4. The assembly of claim 3, further including said second straight section of said connection member extending from said first straight section of said connection member at a right angle.

5. The assembly of claim 3, further including an outer surface of a junction between said first straight section and said second straight section being rounded.

6. The assembly of claim 2, further including said faceplate having a beveled edge extending around said faceplate.

7. The assembly of claim 3, further including said second straight section of said connection member having a circular transverse cross-sectional shape.

8. The assembly of claim 1, further including said plate being a base plate configured for standing on a support surface.

9. The assembly of claim 8, further including said connection member extending perpendicularly from a center of a top surface of said base plate.

10. The assembly of claim 8, further including said connection member having a consistent circular transverse cross-sectional shape extending along a full length of said connection member.

11. The assembly of claim 10, further including said base plate having a beveled edge.

12. The assembly of claim 1, further comprising:

said plate having a first straight edge and a second straight edge;

a first wall coupled to and extending from said first straight edge defining a first lip configured for engaging a first edge of a trough; and a second wall coupled to and extending from said second straight edge defining a second lip configured for engaging a second edge of a trough whereby said plate is coupled to the trough and said plate spans an opening of said trough.

13. The assembly of claim 12, further including said first wall and said second wall being positioned in parallel planes perpendicular to said plate.

14. The assembly of claim 13, further including a height of said first wall being greater than a height of said second wall whereby a bottom edge of said second wall is upwardly offset from a bottom edge of said first wall relative to said plate.

15. The assembly of claim 12, further including said connection member extending perpendicularly from a center of a top surface of said plate.

16. The assembly of claim 12, further including said connection member having a consistent circular transverse cross-sectional shape extending along a full length of said connection member.

17. The assembly of claim 1, further comprising:

said plate having a first straight edge and a second straight edge;

a first wall coupled to and extending from said first straight edge defining a first lip configured for engaging a first edge of a trough;

a second wall coupled to and extending from said second straight edge defining a second lip configured for engaging a second edge of a trough whereby said plate is coupled to the trough and said plate spans an opening of said trough;

said first wall and said second wall being positioned in parallel planes perpendicular to said plate, a height of said first wall being greater than a height of said second wall whereby a bottom edge of said second wall is upwardly offset from a bottom edge of said first wall relative to said plate; and said connection member extending perpendicularly from a center of a top surface of said plate, said connection member having a consistent circular transverse cross-sectional shape extending along a full length of said connection member.

18. The assembly of claim 1, further comprising:

said plate being a base plate configured for standing on a support surface, said base plate having a beveled edge; and said connection member extending perpendicularly from a center of a top surface of said base plate, said connection member having a consistent circular transverse cross-sectional shape extending along a full length of said connection member.

19. The assembly of claim 1, further comprising:

said plate being a faceplate having a pair of spaced apertures whereby said faceplate is configured for coupling to a support wall, said faceplate having a beveled edge extending around said faceplate;

said connection member having a first straight section extending from said faceplate and a second straight section extending between said first straight section and said free second end of said connection member, said second straight section of said connection member extending from said first straight section of said connection member at a right angle;

an outer surface of a junction between said first straight section and said second straight section being rounded; and said second straight section of said connection member having a circular transverse cross-sectional shape.

* * * * *